US007303517B2

(12) United States Patent
Pandozy

(10) Patent No.: US 7,303,517 B2
(45) Date of Patent: Dec. 4, 2007

(54) MOTORIZED INVERSION GRAVITY MACHINE FOR THE BODY

(76) Inventor: Raffaele Martini Pandozy, 280 Lafayette St. Apt. 2A, New York, NY (US) 10012

( * ) Notice: Subject to any disclaimer, the term of this patent is extended or adjusted under 35 U.S.C. 154(b) by 0 days.

(21) Appl. No.: 10/950,861

(22) Filed: Sep. 27, 2004

(65) Prior Publication Data

US 2006/0073956 A1 Apr. 6, 2006

(51) Int. Cl.
*A63B 26/00* (2006.01)

(52) U.S. Cl. ..... 482/144; 482/145

(58) Field of Classification Search ..... 482/144, 482/145

See application file for complete search history.

(56) References Cited

U.S. PATENT DOCUMENTS 1,693,810 A * 12/1928 Melville et al. ..... 606/242
2,123,233 A * 7/1938 Crawford ..... 482/24
2,516,553 A * 7/1950 Cole ..... 5/86.1
3,081,085 A * 3/1963 De Girolamo ..... 482/144
3,083,037 A * 3/1963 Gordon et al. ..... 280/206
3,276,777 A * 10/1966 Pruitt, Sr. ..... 472/17
3,388,700 A * 6/1968 Mountz ..... 601/5
3,519,268 A * 7/1970 McQueen ..... 472/16
3,568,669 A * 3/1971 Stites ..... 606/244
3,589,358 A * 6/1971 Megal ..... 606/244
3,593,703 A 7/1971 Steele
3,593,708 A * 7/1971 Steele ..... 602/32
3,602,501 A * 8/1971 Garner ..... 482/145
3,685,511 A 8/1972 Alvarez
4,113,250 A * 9/1978 Davis ..... 482/144
4,461,287 A * 7/1984 Takahashi ..... 482/144
4,470,408 A * 9/1984 Gordon ..... 482/144
4,531,514 A * 7/1985 McDonald et al. ..... 606/241
4,672,697 A * 6/1987 Schurch ..... 5/610
4,703,929 A 11/1987 Reed
5,180,161 A * 1/1993 Jordan ..... 482/143
5,337,908 A * 8/1994 Beck, Jr. ..... 212/312
5,718,660 A * 2/1998 Chen ..... 482/144
5,876,314 A * 3/1999 Sugimura ..... 482/144
5,967,956 A * 10/1999 Teeter ..... 482/144
6,554,747 B1 * 4/2003 Rempe ..... 482/38
6,592,502 B1 * 7/2003 Phillips ..... 482/143
6,637,055 B1 * 10/2003 Nanan ..... 5/610
6,705,974 B1 * 3/2004 Tardif ..... 482/39
6,790,194 B1 * 9/2004 Katane et al. ..... 602/36
7,094,189 B2 * 8/2006 Fallacaro ..... 482/148
7,125,372 B1 * 10/2006 Teeter et al. ..... 482/144
2002/0132709 A1 * 9/2002 Varga ..... 482/78
2002/0187880 A1 * 12/2002 Johnson ..... 482/78
2006/0247108 A1 * 11/2006 Rastegar et al. ..... 482/139

* cited by examiner

*Primary Examiner*—Lori Amerson
(74) *Attorney, Agent, or Firm*—Schultz & Associates, P.C.

(57) ABSTRACT

An inversion apparatus for performing exercises of suspending the body of a person in an inverted position. The inversion apparatus including a stable steel frame, a winch, and a pair of padded anchor rings which connect the feet of the person to a winch operated by a motor or manually. Controls are provided for the person to operate the winch at will, to move the person up and down to a controlled and gradual elevated, inverted position. The person may also perform multiple exercises in the inverted position. For this reason a series of horizontal crossbars have been included in the design. A time delay in the winch system controls the movements of the winch in order to avoid a run-on condition in which the winch might fail to reverse.

14 Claims, 5 Drawing Sheets

AMENDED

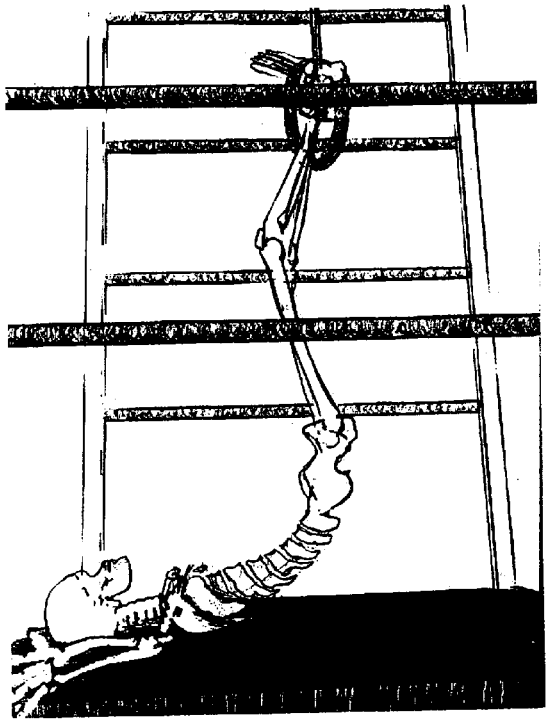
Fig. 13
Fig. 14
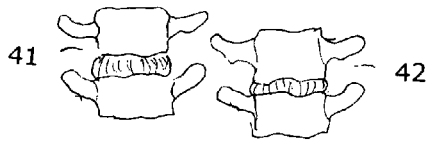
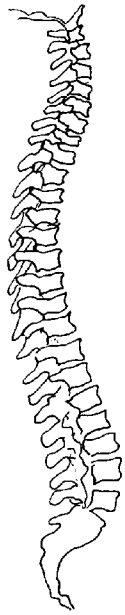
Fig. 15

MOTORIZED INVERSION GRAVITY MACHINE FOR THE BODY

BACKGROUND OF THE INVENTION

1. The Field of the Invention

This invention relates to equipment used for the physical well being, fitness, spinal health, flexibility, good alignment and relaxation of the spine. It is now a scientific fact that all physical exercises, whether done as free body movements or apparatus induced as well as all sports, involving running jumping, weigh lifting, that have vertical or lateral impact, etc. compress the spinal disks or produce lateral, negative and dangerous solicitations to the spine. Excessive and prolonged disks compression and lateral solicitations may produce laceration, hernia, and/or dislocation of the intervertebral disks, as well as pinched nerves, torn cartilage and even arthritis, lordosis, kyphosis, as long term conditions. For many years, ancient cultures have practiced standing on one's head as a mind-body discipline to achieve the centering of the body's energy, realigning the spine to its proper and natural curvature, spinal awareness, relief from pressure, improve vascular and capillary blood circulation, heart conditions, etc. This invention does all the above much better, for by anchoring and pulling the body from the feet gradually and gently stretches and realign each vertebrae and every part of the body inch by inch and brings the body to a perfect inverted vertical position.

2. The Related Prior Art In U.S. Patent

U.S. Pat. No. 3,685,511 to Francisco Alvarez discloses an inversion apparatus in which a person can be strapped to a frame and suspend himself at an angle, with his head upward to apply tension to his spine. This apparatus, however suspends a person from the hips, does not achieve full inversion as in the present invention, and does not stretch and realign the body in a gradual and total way from the feet up.

U.S. Pat. No. 3,593,708 to Victor Steele discloses an inversion apparatus in which a person can suspend himself enmeshed in a frame with his thighs supported in a pad, to suspend a person from his thighs. This apparatus, however suspends a person from the hips, does not achieve full inversion as in the present invention, and does not stretch and realign the body in a gradual and total way from the feet up.

U.S. Pat. No. 4,703,929 to Frank G. Reed discloses an inversion apparatus in which a person can suspend himself enmeshed in a frame with his thighs supported in a pad, and his knees around another pad to suspend a person from his thighs. This apparatus, however suspends a person from the hips, does not achieve full inversion as in the present invention, and does not stretch and realign the body in a gradual and total way from the feet up.

SUMMARY OF THE INVENTION

A motorized inversion apparatus for suspending a person, feet up head down, comprising a steel frame, a motorized winch, two anchoring padded and lined rings for attaching the feet to the apparatus, and a control pendant activating a delay electrical circuit, a safety switch that raises and lowers the body of the user for the purpose of decompressing spinal disks, realigning, correcting anomalous spinal curvatures, rendering spinal flexibility, achieving spinal awareness, improving cardiovascular and capillary blood and lymphatic circulation, correcting varicose vein, cellulite, exercising the heart, clearing the urinary tracks from mineral deposits, improving endocrine system, etc.

A controlled method made of four basic steps, for gradually and gently stretching the vertebral column, inch by inch, from the bottom up, to the last cervical vertebra; for post-surgery rehabilitation exercises; for realigning and bringing the vertebral column back to its natural curvature; for rendering the spine flexible, as well as, for improving general spinal health.

BRIEF DESCRIPTION OF THE DRAWINGS

FIG. 13 showing increasing intervertebral space during the lifting of the body.

FIG. 14 showing section of decompressed and compressed vertebra.

FIG. 15 showing correct alignment of the human spine.

DESCRIPTION OF THE PREFERRED EMBODIMENT

Figure 2:
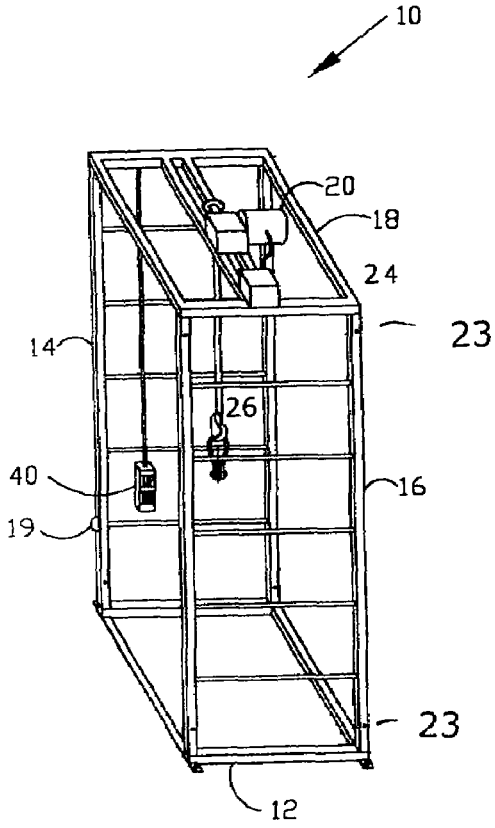
FIG. 2 is an exploded perspective view of the invention.
Figure 2:
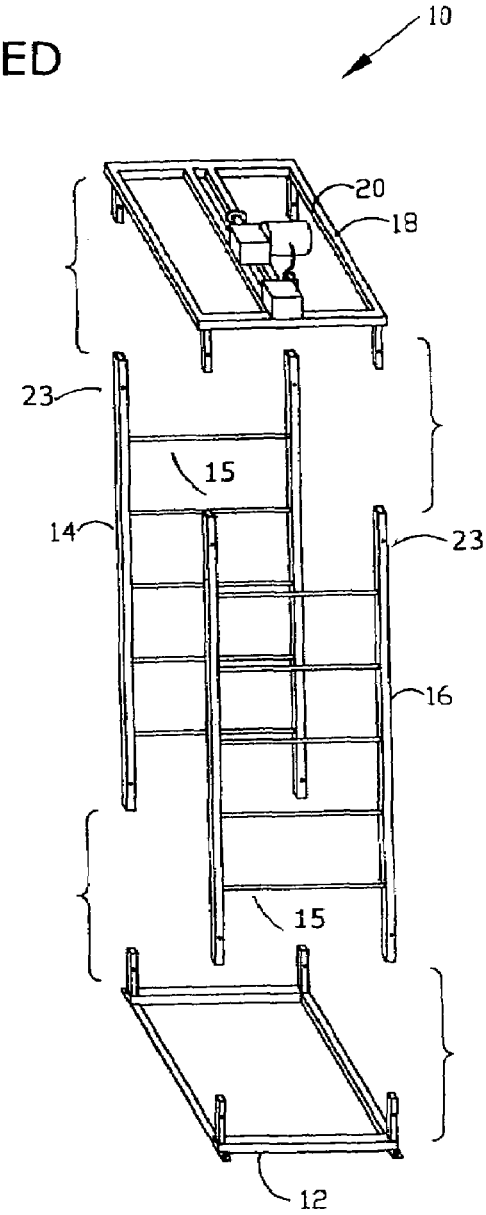
Figure 1:
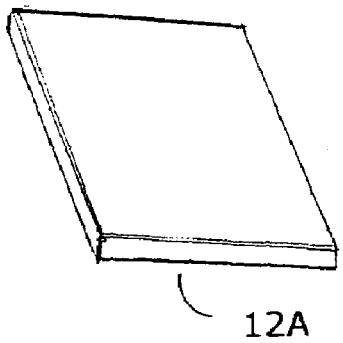
FIG. 1 is a perspective view of the invention in all its parts included the lined foam mat.

FIGS. 1 and 2 show the general view of the invention. FIG. 1 shows the assembled motorized inversion gravity apparatus and the lined framed pad 12A to be inserted in base of frame 12. FIG. 2 shows an exploded drawing of the inversion apparatus. A base 12 supports vertical strut frame side members 14 and 16, having horizontal cross members 15, although it is understood that the cross members 15 could be at an angle other than horizontal. Cross members 15 inside member 14 and member 16 are spaced apart and provide for safety, as hand holds, and also as bars to grasp to perform exercises while suspended in the inversion apparatus. A mechanical alarm 19 attached to vertical side member 14 is provided in the unlikely event of a power failure, in order to summon assistance in case of an extended power failure. A top assembly 18 supports the winch 20. Winch 20 may be powered by a direct current or an alternating current motor or manually. Bolts 23 are used to hold the assembly together. The top assembly needs to be positioned high enough to allow the winch 20 to lift the user to a fully vertical, inverted position. Space constraints may dictate a maximum height for the inversion apparatus. The top assembly may be placed six, to ten feet to accommodate all size users.

Figure 3:
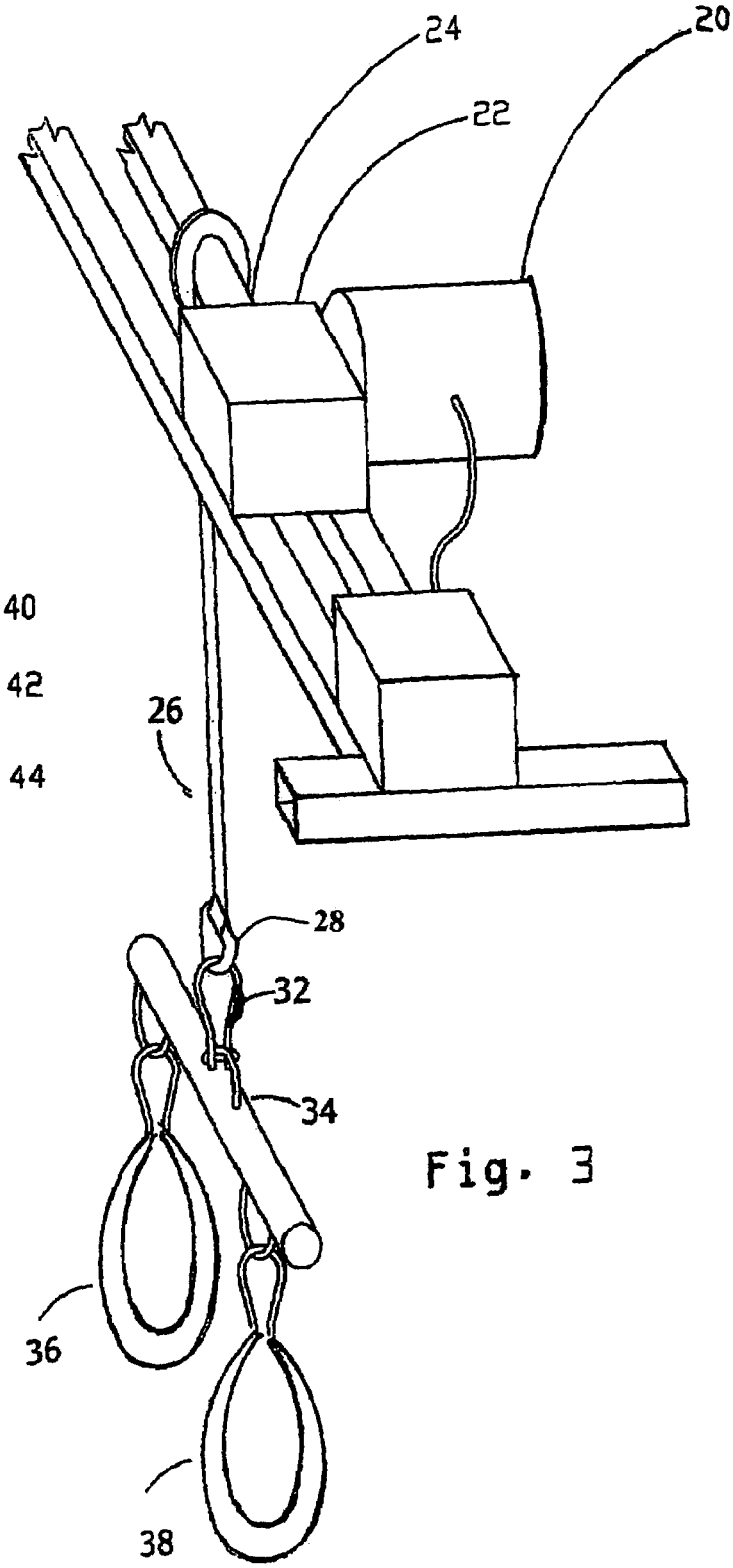
FIG. 3 is an enlarged partial perspective view of the invention, showing detail of the winch portion and anchor loop rings that wrap around the ankles of the user.
Figure 5:
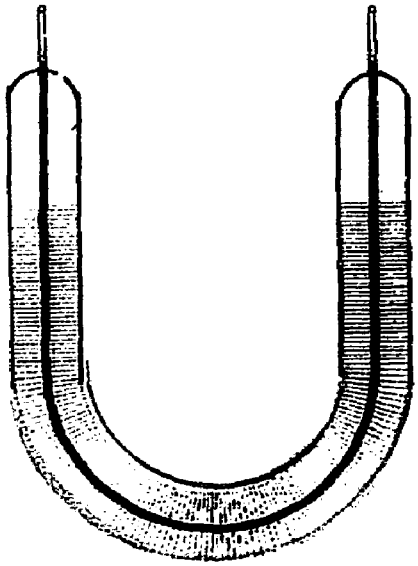
FIG. 5 is a schematic view of the urethane anchor rings and core webbing for their reinforcement.

Referring to FIGS. 2 and 3, the winch 20 mounted on the top assembly 18, FIG. 2. A gear reducer 22 forms a portion of winch 20, along with drum 24. A flexible tension member, belt (Webbing, rope or chain) 26 is suspended from the winch 20 and is rolled onto and off of the drum 2 as drum 24 is rotated to raise and lower the loop 28 and spring hook 32. Tee bar 34 is connected to spring hook 32. Anchor loops 36 and 38 are connected to (loops on tee bar 34. Anchor rings 36 and 38 wrap around the ankle of the user to securely lift the user without cutting blood circulation on the foot while in the inverted position. The anchor rings may be secured with Velcro fasteners 25, FIGS. 6-8. Fabric, leather, or other materials may be used rather than urethane padding.

Figure 4:
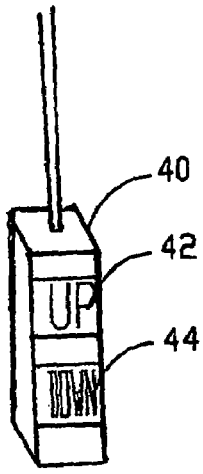
FIG. 4 is a perspective drawing of the control pendant.

Referring to FIGS. 1 and 4, a control pendant switch 40 is suspended from the top assembly 18, in convenient position for use by the user. The pendant has an "UP" button 42 and a "DOWN" button 44 and is operable connected to the winch 20. Lift by the winch 20 is operational while the up button 42 is depressed to close the appropriate switch. Descent by the winch is operational while the down button 44 is depressed to close the appropriate switch. All motion of the winch stops while neither up button 42 nor down button 44 is depressed.

The winch is controlled by a circuit well known from prior art to raise and lower the user of the inversion gravity apparatus, wherein the winch takes up belt 26, thereby lifting while the up button 42 is depressed, and pays out the belt 26 while the down button 44 is depressed. A delay in closing the up and down circuits is necessary, since experiments have indicated that while the winch is moving in one direction, instantaneously depressing the other button would not result in a change in direction of an alternating circuit winch motor, but would result in continuing operation in the same direction. This is not acceptable for safety. The solution to this problem was to use a time delay in the operation of the relays in the circuit, giving the winch motor sufficient time to spin down in speed before the circuit is completed and re-energize and turn in the opposite direction. A time delay of 250 milliseconds is necessary to prevent and alternating current motor winch from continuing rotation in the same direction. A delay of 500 milliseconds is more reliable in preventing the continuation of rotation of the winch motor in the same direction if one control button 42 or 44 is depressed rapidly after the other.

Figure 6:
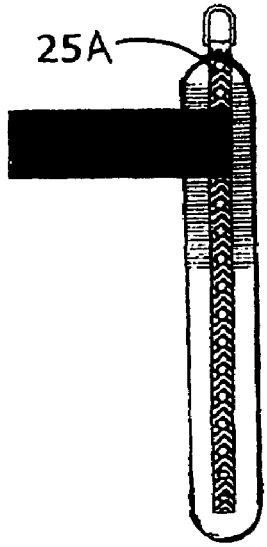
FIG. 6 is a schematic lateral view of the urathane anchor strap with core webbing and one side of Velcro fastener.
Figure 7:
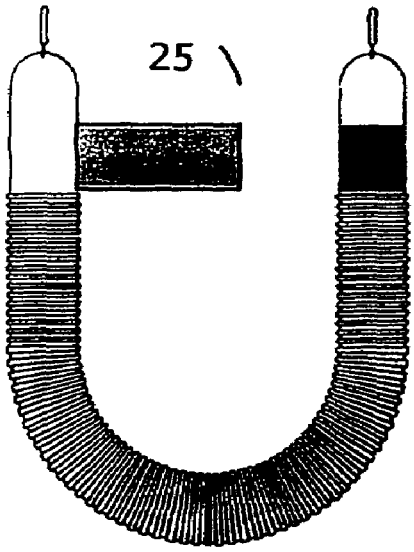
FIG. 7 External view of the urathane anchor strap with two sides of Velcro fastener.
Figure 8:
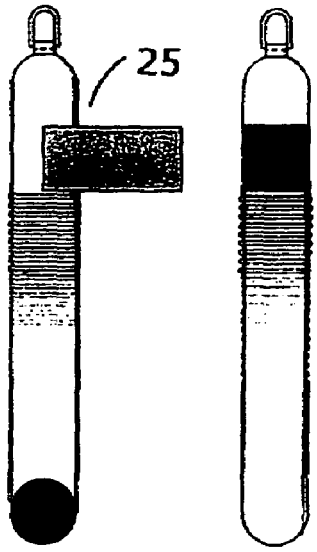
FIG. 8 External section of the urethane anchor strap with the two sides of fastener.

Referring to FIGS. 3 and 6 are two urethane anchor loops 36 and 38 while FIGS. 5-8, same loops are shown to be molded around two core nylon webbing 25A to which metal rings are sawn as to attach to bar 36. Webbing are of considerable strength (3,000 LB capacity). In this way both strength and comfort are obtained. Comfort stand as zero possibility that the user will feel numbness in the feet, as opposed to common inversion boots, existing in the market.

DESCRIPTION OF THE METHOD

Figure 9:
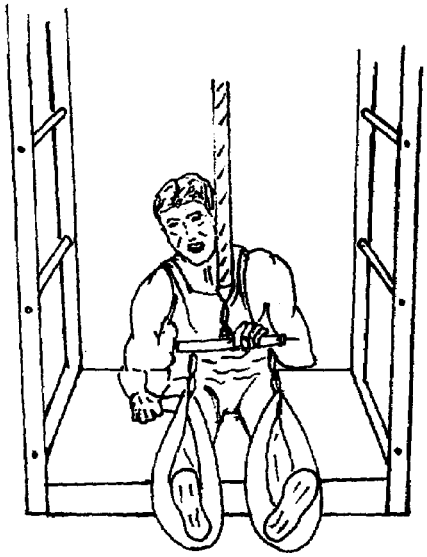
FIG. 9 showing Step one for the apparatus user in a sitting position and placing feet inside the anchor loops.
Figure 10:
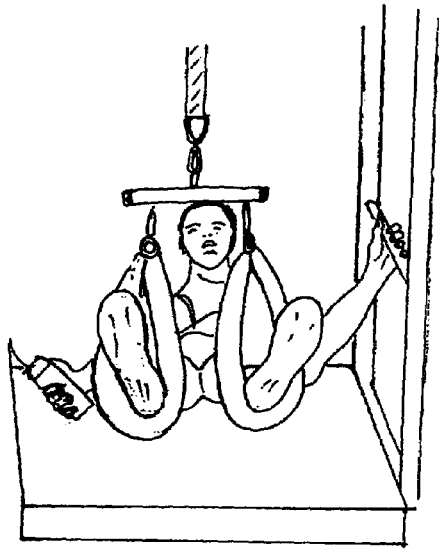
FIG. 10 showing Step two for the apparatus user lying on the mat, holding onto the horizontal bar and activating the up-down switch.
Figure 11:
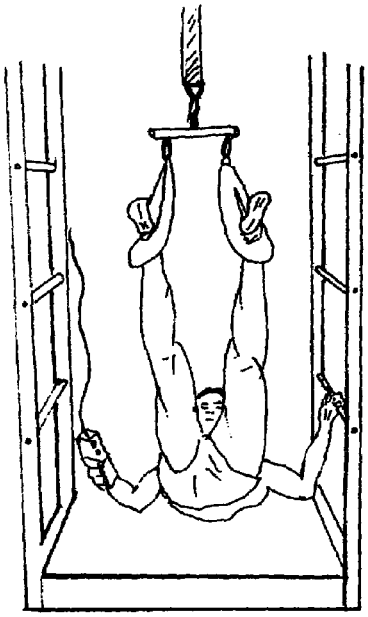
FIG. 11 showing Step three for the apparatus user gradually lifting his body to an inverted vertical position.
Figure 12:
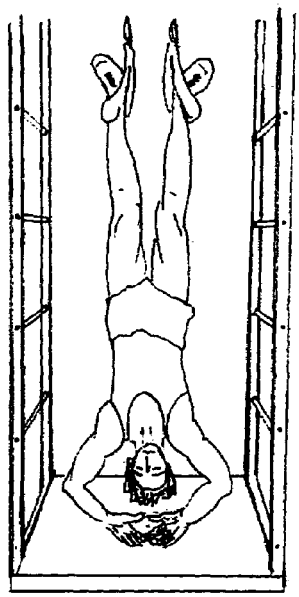
FIG. 12 showing the apparatus user having reached a total inversion of the body.

As opposed to ordinary inversion tables or hang up boots, the method conforms with the apparatus designed to allow the user to obtain a gradual and gentle stretching of the spine and subsequent decompression of spinal disk starting from the lower lumbar vertebrae up to the cervical vertebrae and to reach a gradual and controlled gravity inversion and centering of the body. This method should be applied for proper use of the apparatus and also for equalizing the negative stress occurring before and after performing fitness and sport exercises or even after sitting for long hours. Control and gradual gravity inversion is very important especially when spinal injuries are to be overcome or post surgery rehabilitation is to be achieved. The method so designed is excellent for also correcting some postural and physiological conditions of spinal abnormality, back and neck pains affecting more than 90 Million Americans. FIGS. 9-15 show the substance of the invention, namely, the basic four steps the user follows in order to accomplish full physical benefits. In FIG. 9 the user is shown seated on the rubber pad, inserting the feet inside the two anchor rings. In FIG. 10, the user is reclining and activating the up-down switch. In FIG. 11, the user is activating the winch which is gradually lifting his entire body. In FIG. 12, the user has obtained a full inversion of the body and can now stretch, relax and center the body, allow to decompress the spinal disks, align or reacquire the spinal natural curvature, improve spinal flexibility and spinal awareness, and much more. FIG. 13 clearly showing the gradual opening of the intervertebral spaces which relieves the often compressed intervertebral discs. "Decompression" precisely stands for relief from pressure onto the discs which are allowed to refurbish themselves with fluid. FIGS. 14, 41 and 42 showing a decompressed disc as opposed to a compressed one. FIG. 15 showing a natural curvature which the apparatus helps reacquire simply by applying gravity force exercised by the weight of the body, thus without stress and without mechanical pressure.

I have disclosed in this way an apparatus according to which the means for controlling the winch include a control unit connected to the winch, a switch unit accessible to a user of the apparatus at all time of the operation, a switch in the switch unit that activates upward and downward movements of the winch, with a delay timer to delay both movements of the winch for at least 250 milliseconds for a smoother lifting, and a smoother descent of the body. I have disclosed apparatus wherein the means for controlling the winch includes the switch in the switch unit to activate upward movement of the winch, with a delay timer to delay upward movement of the winch for at least 500 milliseconds, and a switch in the switch unit to activate downward movement of the winch, with a delay timer to delay downward movement of the winch for at least 500 milliseconds. I have disclosed the method of inversion of a human user comprising the steps of placing the two feet of the user inside the anchor rings, rings attached to a winch and each fitted in a caption type the ankles of the human user, using a pendant switch for activating an electric winch to lift the user's body into an inverted position, and using a pendant switch for activating the electric winch to lower the user's body from the inverted position.

Although elements of the invention have been illustrated in the accompanying drawing and described in the foregoing Description will be understood that the invention, both in his design and method is not limited to the embodiments and the steps disclosed, but is capable of rearrangements, modifications, substitutions and reversals of parts, elements and/or additional method steps without departing from the spirit of the invention.

The invention claimed is:

1. An apparatus designed to raise the body of a user from an initial position to an inverted position, by the ankles of the user, for the purpose of stretching the muscles of the body of the user and the cartilage of the spine of the user for greater flexibility and re-alignment of the spine, and for opening the intervertebral spaces of the spine for the purpose of decompressing the intervertebral discs of the spine, for improved blood and lymphatic circulation of the user, and to lower the body of the user to the initial position comprising:

a four part steel frame including at least two vertical sides and having two sets of horizontal tubular bars, a bottom section accommodating a cushion base made of soft plastic foam on which to rest the body of the user and a top section;

the top section positioned at least five feet above the bottom section and supported by the four part steel frame;

a winch means, driven by a mechanical driver and mounted to the top section, for moving a flexible tension member and a pair of padded anchor rings;

the anchor rings, made of a urethane foam surrounding a core of webbing, being secured around the ankles of the user to support the weight of the user and raise the user to the inverted position;

a pair of spring hooks connecting the pair of padded anchor rings to the tension member; and, a switch, connected to the mechanical driver, for controlling the winch means.

2. In an apparatus designed to raise the body of a user from an initial position to an inverted position, by the ankles of the user, for the purpose of stretching the muscles of the body of the user and the cartilage of the spine of the user for greater flexibility and re-alignment of the spine, and for opening the intervertebral spaces of the spine for the purpose of decompressing the intervertebral discs of the spine, for improved blood and lymphatic circulation of the user, and to lower the body of the user to the initial position, a method of anchoring the user and lifting the user to the inverted position comprising:

providing a four part steel frame including at least two vertical sides and two sets of horizontal tubular bars, a bottom section accommodating a cushion base on which to rest the body of the user, made of soft plastic foam, and a top section;

positioning the top section at least five feet above the bottom section;

supporting the top section by the four part steel frame;

providing a winch means, driven by a mechanical driver and mounted to the top section, for moving a flexible tension member and a pair of padded anchor rings;

securing the anchor rings, made of a urethane foam surrounding a core of webbing, around the ankles of the user to support the weight of the user and raise the user to the inverted position;

providing a pair of spring hooks connecting the pair of padded anchor rings to the tension member;

providing a switch, connected to the mechanical driver, for controlling the winch means;

placing the user in a seated position, adjacent the four part steel frame and inserting ankles of the user into the pair of padded anchor rings;

reclining the user;

activating a switch to operate the winch means;

raising the legs of the user by the ankles; and, raising the user to the inverted position.

3. The apparatus of claim 1, wherein the top section is positioned at least six feet above the bottom section.

4. The apparatus of claim 1, wherein the stop section is positioned at least seven feet above the bottom section.

5. The apparatus of claim 1, wherein the mechanical driver is a DC electric motor.

6. The apparatus of claim 1, wherein the mechanical driver is an AC electric motor.

7. The apparatus of claim 1, wherein the mechanical driver is a manual hand crank and the switch controls a direction of rotation of the winch means.

8. The apparatus of claim 1 further comprising a mechanical alarm, attached to the four part steel frame, accessible to the user in the inverted position.

9. The apparatus of claim 1 where the at least two vertical sides comprise at least one vertical strut and a plurality of cross members fixed to the at least one vertical strut.

10. The apparatus of claim 9 where the plurality of cross members are oriented horizontally.

11. The apparatus of claim 1 further comprising:

the switch mounted in a pendant box;

the pendant box being reachable by the user in a set of positions between the initial position and the inverted position;

the switch including a delay timer to delay upward movement of the anchor rings by at least 250 milliseconds from a first signal received from the switch; and, the delay timer to delay downward movement of the anchor rings by at least 250 milliseconds from a second signal received from the switch.

12. The apparatus of claim 11 wherein the delay timer delays upward movements of the anchor rings by at least 500 milliseconds from the first signal received from the switch and by at least 500 milliseconds from the second signal received from the switch.

13. The method of claim 2 further comprising:

using the body weight of the user to secure the anchor rings to the user.

14. The method of claim 2 further comprising:

stretching the muscles of the user and the cartilage of the spine of the user;

decompressing the intervertebral discs of the user; and, re-aligning the spine of the user.

* * * * *